United States Patent [19]

Fish

[11] Patent Number: 4,945,889

[45] Date of Patent: Aug. 7, 1990

[54] BELT-CONFIGURED SAW FOR CUTTING SLOTS INTO STONES HAVING A POLY-CRYSTALLINE DIAMOND CUTTING SURFACE

[75] Inventor: Donald D. Fish, Bedford, Ind.

[73] Assignee: W. F. Myers Company, Inc., Bedford, Ind.

[21] Appl. No.: 131,461

[22] Filed: Dec. 11, 1987

[51] Int. Cl.[5] ..... B28D 1/08

[52] U.S. Cl. ..... 125/21

[58] Field of Search ..... 125/21, 22; 51/357

[56] References Cited

U.S. PATENT DOCUMENTS

| | | | |
|---|---|---|---|
| 2,368,092 | 1/1945 | Anderson | 125/21 |
| 3,509,704 | 5/1970 | Henzman | 125/21 |
| 3,587,679 | 6/1971 | Conte | 125/21 |
| 3,741,192 | 6/1973 | Avery | 125/21 |
| 3,884,212 | 5/1975 | Armstrong et al. | 125/21 |
| 4,603,678 | 8/1986 | Fish | 125/21 |
| 4,679,541 | 7/1987 | Fish | 125/21 |

*Primary Examiner*—J. J. Hartman

*Attorney, Agent, or Firm*—Woodard, Emhardt, Naughton, Moriarty & McNett

[57] ABSTRACT

A stone cutting belt includes a flexible and continuous main body with length and lateral width, having a top surface and a bottom surface. The belt includes a pluraity of cutter segments, each comprising a preferably metallic drive block and a metallic carrier block mounted on the top surface of the drive block. The carrier block includes a tooth slot in which a cutting tooth is mounted, such as by silver soldering. The cutting tooth can be a poly-crystalline diamond tooth with a tungsten carbide substrate. The cutting tooth is mounted so that the tooth projects slightly above the top surface of the belt main body. Continuous cables extend along the entire length of the belt and through bores in the plurality of drive locks. The main body is of a resilient material in which the cutter segments and cables are embedded in an injection molding process. The cutter segments are held in position at spaced intervals along the length of the belt by the resilient body. The cutting teeth are arranged in a repeated pattern including two groups of teeth. In one group, the teeth are arranged to converge alternately from each of the opposite sides of the belt toward the center of the belt until a continuous cutting width has been formed. The second group of teeth are similarly arranged, except that the teeth in the second group overlap the teeth of the first group to eliminate streaks along the cutting path.

12 Claims, 2 Drawing Sheets

BELT-CONFIGURED SAW FOR CUTTING SLOTS INTO STONES HAVING A POLY-CRYSTALLINE DIAMOND CUTTING SURFACE

BACKGROUND OF THE INVENTION

This invention relates to stone cutting devices in general, and in particular to such a device having a flexible and continuous stone cutting belt.

Various means have been developed over the years for cutting and removing hard natural stone from quarries. In U.S. Pat. No. 3,884,212, I disclosed an improved wire saw that is adaptable for cutting stone which is still in the ground. This wire saw includes abrasive cutting elements sleeved over an endless flexible wire, and a pressure molded-in-place resilient material surrounding the cable and providing a substantially uniform diameter for the endless saw.

In another method for removing stone from the ground, it is known to drill holes in stone and then wedge large pieces of stone out with mechanical means employing hydraulics and pneumatics. This method is difficult, time consuming, and does not result in a smooth, cut surface on the stone. A device known to be used in Europe includes a jib pivotally mounted to a vehicle having aligned sprockets and a guidebar to drive a continuous chain on which diamond cutting bits are attached for cutting stone. The jib travels through the stone as it is cut away by the chainsaw. Several problems are associated with using this chain-type saw. The chain is heavy, expensive, and must be run a slow speeds because of its mechanical construction. The chain also causes vibration, or chatter, during operation and wears out easily. Should the chain break during operation, it may perilously fly off the jib.

In U.S. Pat. No. 4,603,678, I disclosed an improved belt-configured saw for cutting a slot in stone, comprising a mainframe, a jib movable mounted to the mainframe, and a continuous flexible belt extending around and in driven engagement with sheaves on the jib. The belt includes a plurality of spaced apart abrasive cutting strips extending across the top and sides of the belt. This belt-configured saw employs a grinding action rather than a cutting action to remove the stone. Since this belt-configured device operates by a grinding action, greater energy is required to drive the belt than would ordinarily be required for a device operating by a cutting action. In addition, the grinding action of this type of belt-configured saw requires higher belt tension so that the abrasive cutting strips can be fully operative. Moreover, the abrasive cutting strips, produced from a powdered metal mix, such as bronze having diamonds positioned uniformly throughout, are expensive and difficult to produce.

SUMMARY OF THE INVENTION

A stone cutting belt includes a flexible and continuous main body with length and lateral width, having a top surface and a bottom surface. The bottom surface is configured to be drivenly engaged by a sheave. An elongated member extends through the main body along the length thereof to provide belt strength. The belt includes a plurality of stone cutting elements, each element having a width substantially less than the lateral width of the main body. Means are provided for mounting each of the plurality of stone cutting elements to the main body such that the plurality of elements are spaced along the length thereof and such that at least a portion of each of the cutting elements projects above the top surface of the main body. The stone cutting elements are staggered across the lateral width of the main body in a repeated pattern to form a continuous cutting width at least equal to the lateral width of the main body. The stone cutting elements may include a poly-crystalline diamond tooth in a tungsten carbide substrate.

In accordance with the present invention, one object is to provide an improved stone cutting device employing a stone cutting belt, that is adapted for cutting stone which is in the ground. Another object is to provide a device for high speed cutting of a slot in stone which is in the ground.

Another object of the present invention is to provide a device for removing stone by a cutting action rather than by a grinding action, thereby reducing the power required to drive the cutting device. Yet another object is to provide a device that minimizes the vibration or chatter associated with the cutting operation.

Figure 4:
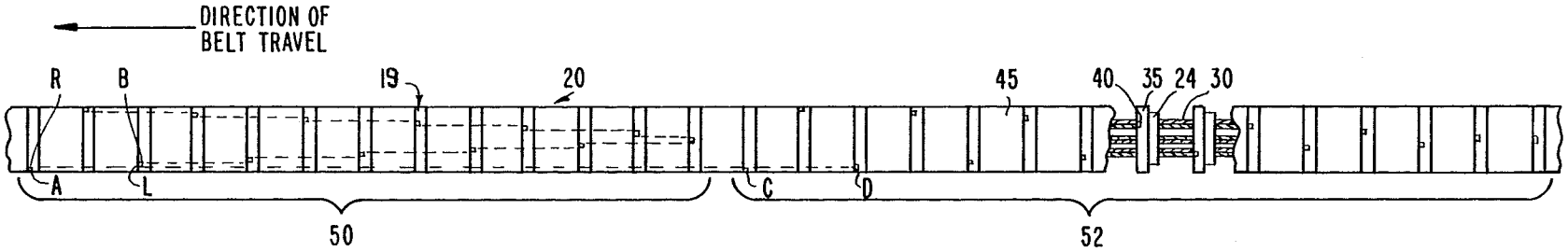
FIG. 4 is a reduced fragmentary top view of the belt engaged on the jib shown in FIG. 1, taken along line 4—4 in FIG. 1 and viewed in the direction of the arrows.

FIG. **4*a* is an enlarged view of a portion of the belt illustrated in FIG. 4** showing the arrangement of cutting teeth along the belt.

Figure 5:
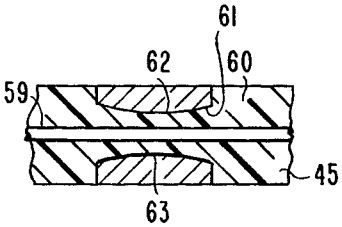

FIG. 5 is a side cross-sectional view of a drive block comprising a portion of the belt in one alternate embodiment of the present invention.

Figure 6:
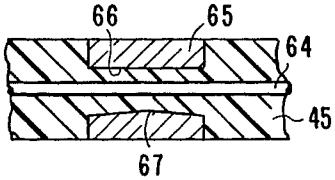

FIG. 6 is an enlarged side cross-sectional view of a drive block in a belt of another embodiment of the present invention.

DESCRIPTION OF THE PREFERRED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
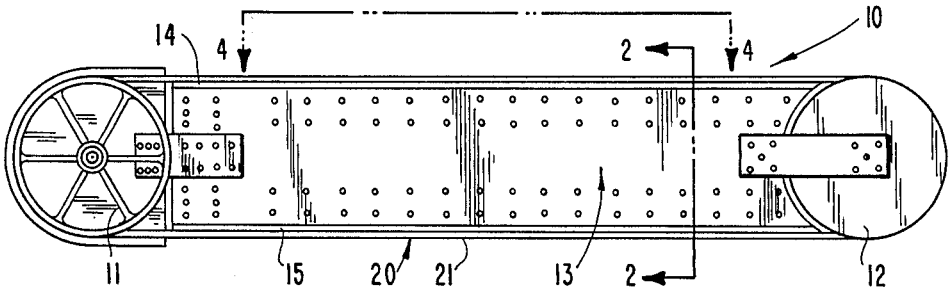
FIG. 1 is a side view of the jib comprising a portion of a stone cutting device in the preferred embodiment of the present invention.

The preferred embodiment of the present invention is a device for cutting a slot in stone located in the ground, including a vehicle atop rails as is known in the art and as is described in my U.S. Pat. No. 4,679,541. The vehicle includes a jib 10, shown in FIG. 1, pivotally mounted to the mainframe of the vehicle. The jib 10 includes a pair of sheaves 11 and 12 mounted to the opposite ends of the jib. A jib frame 13 supports the sheaves 11 and 12 at opposite ends of the frame. Typically, sheave 11 will be situated above ground and will be driven by suitable means mounted in the vehicle. The jib frame 13 includes groove members 14 and 15 mounted to the top and bottom edges of the frame in a conventional manner. Belt 20 extends in a continuous fashion around sheaves 11 and 12 and immediately adjacent and in contact with groove members 14 and 15.

Figure 2:
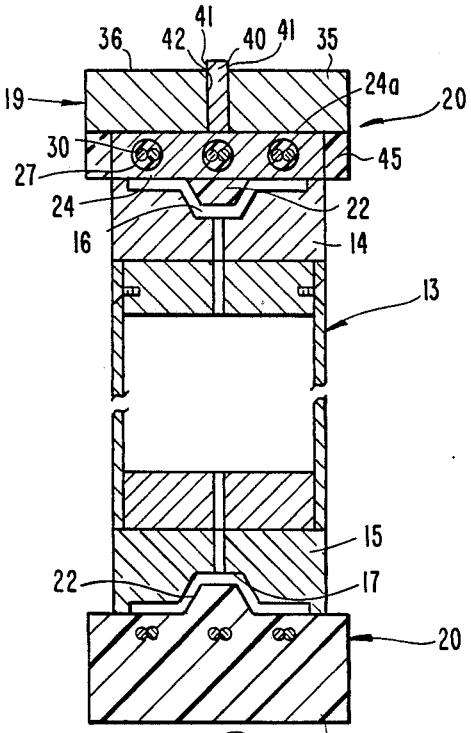
FIG. 2 is a fragmentary enlarged cross-sectional view of a portion of the jib shown in FIG. 1, taken along line 2—2 in FIG. 1 and viewed in the direction of the arrows.

The details of the construction of the belt 20 are illustrated with reference to the cross-sectional view in FIG. 2. The belt 20 includes a plurality of cutter segments 19, each comprising a drive block 24 with a carrier block 35 mounted on the top surface of the drive block by suitable means. In the preferred embodiment, both the drive block 24 and the carrier block 35 are composed of a metal, such as a mild steel suitable for investment casting. The carrier block 35 is brazed onto the drive block 24.

Figure 3:
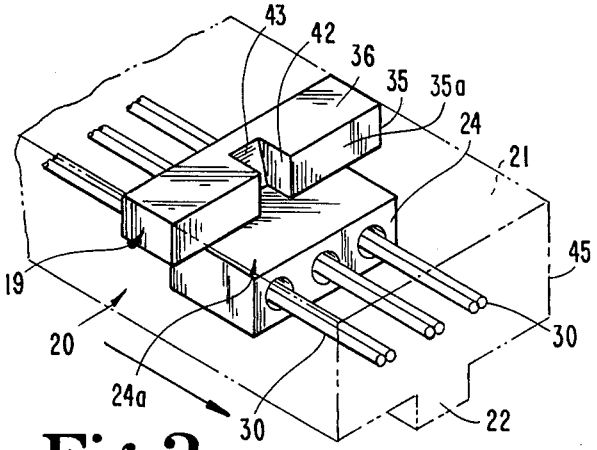
FIG. 3 is an enlarged orthographic view of the belt portion of the jib shown in FIG. 1, with the resilient body portion of the belt shown in phantom for clarity.

The carrier block includes a front face 35*a* with a tooth slot 42 formed therein in which a cutting tooth 40 is mounted. The tooth 40 is situated within the slot 42 and contacts the top surface 24*a* of the drive block 24. The tooth is suitably affixed into the slot 42, such as by silver soldering. The back wall 43 of the tooth slot 42 is slanted rearward at a rake angle, as shown in FIG. 3, relative to the direction of travel of the belt 20, designated by the heavy arrows in FIGS. 3 and 4. In the preferred embodiment, a rake angle of 7°, relative to the vertical, provides a suitable tooth clearance above the top surface 36. At this orientation, the cutting tooth 40 is not prone to "grab" the stone during the cutting operation, which results in a better cutting action with less vibration than in prior art devices.

Figure 4A:
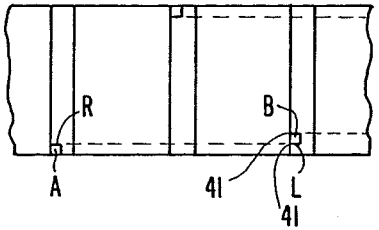

As illustrated in FIGS. 4 and 4*a*, cutting teeth 40 are mounted at the lateral edges of the belt 20, and consequently at the lateral edges of the carrier block 35. Since the drive block 24 in the preferred embodiment extends only partially across the lateral width of the carrier block, as shown in FIGS. 2 and 3, the teeth 40 situated at the lateral edges of the carrier block 35 do not contact the top surface 24*a* of the drive block. Although the silver solder is sufficient to hold the tooth within the slot 42 once the belt 20 is assembled, a special assembly procedure is used to mount the tooth. A graphite locator block (not shown in the figures) is placed under the overhanging portion of the carrier block 35 adjacent the drive block 24. The tooth 40 can then be placed in the slot 42 and contact the top surface of the locator block to position the tooth properly during the soldering operation. Once the tooth is firmly affixed within the slot, the locator block is removed.

In the preferred embodiment, the cutting tooth 40 comprises poly-crystalline diamond mounted in a tungsten carbide substrate, such as is manufactured by the General Electric Corporation as Model #1575 and distributed under the tradename "Compax" by Van Itallie, of Saddlebrook, N.J. In essence, the tooth 40 comprises a large number of small diamonds held together by a substrate or filler. The diamond cutting tooth projects beyond top surface 36 or carrier block 35, and beyond top surface 21 of belt 20, which is flush with top surface 36 of the carrier block as will be described herein. In practice, it has been found that the optimum height or clearance of the cutting tooth above the top surfaces 36 and 21 is about 0.030 inches. At this dimension, optimum cutting performance is achieved with a minimum of vibration or tooth chatter. Moreover, there is little risk of chipping or shearing the top of the cutting tooth 40 at this selected height dimension.

The drive block 24 includes a number of bores 27 extending through the drive block along the length of the belt 20. Wire cables 30 pass through each of the bores 27 individually, each of the cables being continuous through the length of the belt 20 to increase the strength of the belt.

As shown in FIG. 3, the drive block 24, carrier block 35, and cables 30 are embedded in a resilient body 45. The resilient body 45 extends throughout the entire length of the belt 20 and is used to position the plurality of cutter segments 19 along the length of the belt. The belt 20 is formed by placing the cutter segment 19 in an injection mold, with the mold being at approximately 150° F. Polyurethane is then injected into the mold to encapsulate the cutter segments 19 and the continuous cables 30. During the injection molding process, the polyurethane also infiltrates the bores 27 in drive block 24 to surround the cables 30 and securely anchor the drive block 24 to the cables 30. The cutter segment 19 is positioned in the injection mold so that the top surface 36 of the carrier block 35 is positioned flush with the top surface 19 of the belt 20 or resilient body 45. Likewise, the opposite sides of the carrier block and the resilient body are flush.

In the injection molding process, the resilient body 45 is formed with a drive projection 22 (FIGS. 2 and 3) extending from the bottom surface of the belt 20 along the length of the belt. The drive projection 22 extends into grooves 16 and 17 of groove members 14 and 15 of the jib frame 13. The drive projections 22 engage the complementary-shaped outer circumferences of sheaves 11 and 12 so that the belt 20 can be driven by the rotation of the sheave 11.

A top view of the belt 20 is shown in FIG. 4. The belt 20 includes a plurality of cutter segments 19 spaced along the length of the belt, with portions of the resilient body 45 separating each cutter segment. In a cutaway portion of the belt shown in FIG. 4, the positioning of the drive block 24, carrier block 35, cutting tooth 40, and cables 30 are shown. Each cutting tooth 40 is positioned at the upstream face of the carrier block 35, as determined by the direction of travel of the belt 20 indicated by the heavy arrow in FIG. 4. The width of each of the cutting teeth 40 is substantially smaller than the width of the belt 20, so that in the preferred embodiment a first group 50 of thirteen cutting teeth staggered in the pattern shown in FIG. 4 are required to span the entire width of the belt. As shown in FIG. 4, the carrier blocks 35 extend laterally across the entire width of the belt 20. Alternatively, the carrier blocks may extend only partially across the belt width, with the resilient body 45 filling the remaining space.

In the preferred embodiment, the cutting teeth 40 on consecutive cutter segments 19 are arranged to converge alternately from each of the opposite sides of the belt 20. The teeth 40 are arranged such that the lateral distance between pairs of alternate cutting teeth is less than the width of one tooth. Thus, in the preferred embodiment, the distance between alternate cutting teeth is essentially zero. The opposing lateral edges of alternate cutting teeth are coplanar with a plane aligned along the length of the belt, as represented by the dashed lines in FIG. 4. For example, referring to the teeth labeled A and B in FIG. 4 and shown in the enlarged view in FIG. 4*a*, the right edge R of tooth A is in line with the left edge L of tooth B. Cutting teeth in consecutive cutter segments continue to converge in this fashion toward the center of the belt 20 until a continuous cutting width has been formed that is at least equal to the lateral width of the belt.

The first group of thirteen cutting teeth 40, arranged as just described with opposite edges aligned, can generate streaks in the stone along the cutting path coinciding with the dashed lines in FIG. 4 representing the aligned edges of alternate cutting teeth. In order to eliminate these streaks, a second group 52 of cutting teeth is provided. The second group 52, beginning with the cutting tooth labeled C in FIG. 4, follows a similar alternately converging pattern as the first group 50, with the exception that the teeth are staggered to cut along the streak lines generated by the first group of cutting teeth. That is, the planes representing the aligned lateral edges of teeth in the first group 50 intersect at least one of the teeth in the second group 52. Thus, the streak line formed by cutting teeth labeled A and B is eliminated by the cutting tooth labeled D in the second group 52 of stone cutting teeth.

In the preferred embodiment, fifteen teeth are used in the second group 52. The pattern formed by the two groups of cutting teeth 40, the upstream group having thirteen teeth and the downstream group having fifteen teeth, is repeated throughout the entire length of the belt 20. This repeated pattern of cutting teeth 40 ensures that a complete cut is made across the width of the belt 20 without the presence of streaks along the length of the belt. It is apparent, however, that other patterns of cutting teeth are contemplated by the present invention, provided that a continuous cutting path or swath is defined.

In order to further reduce the possibility of streaks along the belt, the leading edges 41 of each of the cutting teeth 40 are rounded. The rounded leading edges 41, along with the staggered arrangement of cutting teeth in the above-described pattern, also helps eliminate vibration or chatter of the belt during a stone cutting operation.

The drive block in each cutter segment 19 contains a bore therethrough as previously described. In an alternate embodiment of the present invention, a drive block 60, as shown in FIG. 5, includes a bore 61 having opposite arcuate interior walls 62 and 63. The features of the belt in this alternate embodiment are identical in all other respects to the previous embodiment. The arcuate walls 62 and 63 form a necked-down portion of bore 61 that is sufficiently large to allow a cable 59 to extend through the bore 61 without contacting either of the arcuate walls. Once the polyethylene has been introduced into the bore 61 during the injection molding process, the necked-down portion of the bore acts to center the cable 59 in the bore 61 so that the resilient body 45 can surround the cable and insulate it from the bore walls. Isolating the cable 59 from the metal walls of the bore 61 prevents wear on the cable that might otherwise occur as the belt flexes while traveling around the sheaves. Once the polyethylene has been injected into the bore 61 around the cable 59, the necked-down portion at walls 62 and 63 further acts to allow the resilient body 45 to grip the drive block 60 against longitudinal motion. The necked-down portion restricts this motion since it would require the resilient block to squeeze through a smaller opening.

In another alternate embodiment of the belt 20, a drive block 65 includes a bore 66 having a single beveled wall 67. The features of the belt in this alternate embodiment are identical in all other respects to the previously described embodiments. The beveled wall 67 also produces a necked-down portion of bore 66 so that a cable 64 extending through the bore isolated from the bore walls and the drive block 65 is restrained as previously described.

While the invention has been illustrated and described in detail in the drawings and foregoing description, the same is to be considered as illustrative and not restrictive in character, it being understood that only the preferred embodiments have been shown an described and that all changes and modifications that come within the spirit of the invention are described to be protected.

What is claimed is:

1. A stone cutting belt comprising:

a flexible and continuous main body with length and lateral width, said main body having a top surface across said lateral width and an opposite bottom surface, said bottom surface having a drive portion adapted to be drivenly engaged by a sheave;

means, extending through said main body along the length thereof, for providing belt strength;

a plurality of stone cutting elements tooth, each of said elements having a width substantially less than the lateral width of said main body; and means for mounting each of said plurality of stone cutting elements in said main body such that said plurality of elements are spaced along the length thereof and such that at least a portion of each of said cutting elements projects above said top surface of said main body, wherein said stone cutting elements are staggered across the lateral width of said top surface of said main body in a pattern to form a continuous cutting width at least equal to the lateral width of said main body wherein said main body includes laterally opposite sides; and said pattern includes;

a first group of said stone cutting teeth converging alternately from each of said opposite sides, wherein the lateral distance between pairs of alternate cutting teeth is less than the width of a cutting tooth; and a second group of said stone cutting teeth converging alternately from each of said opposite sides and lengthwise overlapping each of said lateral distances between each of said pairs of alternate cutting teeth in said first group.

2. The stone cutting belt of claim 1, wherein:

said main body is of a resilient material;

said means for mounting each of said plurality of stone cutting elements includes a plurality of rigid blocks embedded in said resilient material and spaced along the length of said main body; and said stone cutting elements each include a poly-crystalline diamond cutting tooth mounted in each of said rigid blocks such that at least a portion of said tooth projects above said top surface of said main body.

3. The stone cutting belt of claim 1, wherein:

each of said cutting teeth includes a pair of lateral tooth faces; and opposing lateral tooth faces of alternate pairs of cutting teeth in said first group are coplanar with a plane extending along the length of said main body such that said plane intersects one of said cutting teeth in said second group.

4. The stone cutting belt of claim 2, wherein:

said portion of each of said cutting teeth projecting above said top surface includes;

a front tooth face perpendicular to and facing toward the direction of travel of said belt; and a pair of lateral side tooth faces integral with said front tooth face defining a pair of opposite edges between said side tooth faces and said front tooth face, each of said opposite edges being rounded.

5. The stone cutting belt of claim 2, wherein said poly-crystalline diamond cutting tooth includes a plurality of diamond chips held together by a metallic carbide substrate.

6. The stone cutting belt of claim 1, wherein said belt is mounted in a stone cutting device having a main frame, a jib movably mounted to said frame, a pair of spaced apart sheaves rotatably mounted to said jib and means on said main frame for rotating said sheaves, such that said belt extends around said sheaves in driven engagement.

7. The stone cutting belt of claim 2, wherein:

said bottom surface includes a drive projection of said resilient material projecting therefrom and adapted to engage said sheave.

8. A stone cutting belt, comprising:

a flexible and continuous main body with length and lateral width, said main body having a top surface and a bottom surface, said bottom surface having a drive portion adapted to be drivenly engaged by a sheave;

means, extending through said main body along the length thereof, for providing belt strength;

a plurality of stone cutting elements, each of said elements having a width substantially less than the lateral width of said main body; and means for mounting each of said plurality of stone cutting elements in said main body such that said plurality of elements are spaced along the length thereof and such that at least a portion of each of said cutting elements projects above said top surface of said main body, wherein said stone cutting elements are staggered across the lateral width of said main body in a pattern to form a continuous cutting width at least equal to the lateral width of said main body; wherein said main body is of a resilient material;

said means for mounting each of said plurality of stone cutting elements includes a plurality of rigid blocks embedded in said resilient material and spaced along the length of said main body;

said stone cutting elements each include a poly-crystalline diamond cutting tooth mounted in each of said rigid blocks such that at least a portion of said tooth projects above said top surface of said main body; and said means for providing belt strength includes;

at least one bore through each of said plurality of rigid blocks along the length of said main body, said bore including a necked-down portion generally mid-length in said bore; and at least one flexible elongated member extending through each of said at least one bore, wherein each of said elongated members is entirely embedded in said resilient material and is insulated from the walls of said bore by said resilient material.

9. A stone cutting belt, comprising a flexible and continuous main body with length and lateral width, said main body having a top surface and a bottom surface, said bottom surface having a drive portion adapted to be drivenly engaged by a sheave;

means, extending through said main body along the length thereof, for providing belt strength;

a plurality of stone cutting elements, each of said elements having a width substantially less than the lateral width of said main body; and means for mounting each of said plurality of stone cutting elements in said main body such that said plurality of elements are spaced along the length thereof and such that at least a portion of each of said cutting elements projects above said top surface of said main body, wherein said stone cutting elements are staggered across the lateral width of said main body in a pattern to form a continuous cutting width at least equal to the lateral width of said main body;

said main body is of a resilient material;

said means for mounting each of said plurality of stone cutting elements includes a plurality of rigid blocks embedded in said resilient material and spaced along the length of said main body;

said stone cutting elements each include a poly-crystalline diamond cutting tooth mounted in each of said rigid blocks such that at least a portion of said tooth projects above said top surface of said main body; and each of said rigid blocks includes;

a top face flush with said top surface of said resilient main body;

a front face perpendicular to said top face and arranged toward the direction of travel of said belt;

a tooth slot opening from said top face and said front face, including a back wall opposite said opening in said front face, said back wall being sloped away from the direction of travel of said belt, said tooth slot being adapted to receive a cutting tooth therein.

10. A stone cutting belt comprising:

a flexible and continuous main body with length and lateral width, said main body having a top surface across said lateral width and an opposite bottom surface, said bottom surface having a drive portion adapted to be drivenly engaged by a sheave, wherein said main body is of a resilient material;

a plurality of stone cutting teeth, each of said teeth having a width substantially less than the lateral width of said main body; and means for mounting each of said plurality of stone cutting teeth in a pattern on said main body including a plurality of rigid blocks embedded in said resilient material along the length of said main body, each of said plurality of rigid blocks carrying one of said plurality of cutting teeth and having at least one bore therethrough, said at least one bore having ends opening in said rigid blocks along the length of said main body and further having at least one interior wall; and at least one flexible elongated member extending along the length of said main body through said main body and each of said at least one bore, wherein each of said at least one flexible elongated member is entirely embedded in said resilient material and is insulated from said at least one interior wall of said at least one bore by said resilient material wherein said main body includes laterally opposite sides; and said pattern includes;

a first group of said stone cutting teeth converging alternately from each of said opposite sides, wherein the lateral distance between pairs of alternate cutting teeth is less than the width of a cutting tooth; and a second group of said stone cutting teeth converging alternately from each of said opposite sides and lengthwise overlapping each of said lateral distances between each of said pairs of alternate cutting teeth in said first group.

11. A stone cutting belt, comprising:

a flexible and continuous main body with length and lateral width, said main body having a top surface and a bottom surface, said bottom surface having a drive portion adapted to be drivenly engaged by a sheave, wherein said main body is of a resilient material;

a plurality of stone cutting teeth, each of said teeth having a width substantially less than the lateral width of said main body; and means for mounting each of said plurality of stone cutting teeth in said main body including a plurality of rigid blocks embedded in said resilient material along the length of said main body, each of said plurality of rigid blocks having at least one bore therethrough, said at least one bore having ends opening in said rigid blocks along the length of said main body and further having at least one interior wall; and at least one flexible elongated member extending along the length of said main body through said main body and each of said at least one bore, wherein each of said at least one flexible elongated member is entirely embedded in said resilient material and is insulated from said at least one interior wall of said at least one bore by said resilient material; wherein said at least one bore includes a necked-down portion generally mid-length in said at least one bore, said necked-down portion having an effective diameter larger than the effective diameter of said at least one flexible elongated member extending through said at least one bore.

12. The stone cutting belt of claim 11, wherein:

said at least one bore includes at least one pair of opposing walls wherein one of said pair of opposing walls is sloped from said necked-down portion to the ends of said bore.

* * * * *